US008128712B2

(12) United States Patent
Harrison et al.

(10) Patent No.: US 8,128,712 B2
(45) **Date of Patent: *Mar. 6, 2012**

(54) PROCESS FOR PROTECTING THE COLORS OF COLORED TEXTILE ARTICLES OR FOR PROVIDING CREASE RESISTANCE TO TEXTILE ARTICLES

(75) Inventors: Ian Harrison, Poissy (FR); Eric Aubay, Princeton, NJ (US)

(73) Assignee: Rhodia Chimie, Boulogne Billancourt, Cedex (FR)

( * ) Notice: Subject to any disclaimer, the term of this patent is extended or adjusted under 35 U.S.C. 154(b) by 0 days.

This patent is subject to a terminal disclaimer.

(21) Appl. No.: 12/902,834

(22) Filed: Oct. 12, 2010

(65) Prior Publication Data

US 2011/0028376 A1 Feb. 3, 2011

Related U.S. Application Data

(63) Continuation of application No. 12/166,941, filed on Jul. 2, 2008, now abandoned, which is a continuation of application No. 11/787,089, filed on Apr. 13, 2007, now abandoned, which is a continuation of application No. 10/399,652, filed as application No. PCT/FR01/03210 on Oct. 17, 2001, now abandoned.

(30) Foreign Application Priority Data

Oct. 18, 2000 (FR) ..... 00 13334

(51) Int. Cl.
*B08B 3/04* (2006.01)
*C11D 3/22* (2006.01)

(52) U.S. Cl. ..... 8/137; 510/344; 510/462; 510/463; 510/471

(58) Field of Classification Search ..... 510/344, 510/462, 463, 471; 8/137
See application file for complete search history.

(56) References Cited

U.S. PATENT DOCUMENTS

| | | | | |
|---|---|---|---|---|
| 5,405,414 | A | 4/1995 | Pedersen et al. | |
| 5,612,475 | A | 3/1997 | Miemietz et al. | |
| 7,074,919 | B2 * | 7/2006 | Aubay et al. | 536/114 |

FOREIGN PATENT DOCUMENTS

| | | | |
|---|---|---|---|
| EP | 0 072 971 | A2 | 3/1983 |
| EP | 0 290 740 | A2 | 11/1988 |
| WO | WO 98/18828 | * | 5/1998 |

OTHER PUBLICATIONS

Patent Abstract of Japan, vol. 0082, No. 51 & JP 59 128324 (Mitsubishi Acetate KK) Jul. 24, 1984.
Database WPI week 199617 Derwent Publications Ltd, London, GB AN 1996-167424 XP0021164615 & JP 08 0489999 A (Nisshin Oil Mills Ltd.) Feb. 20, 1996.
International Search Report mailed Feb. 6, 2002 in Int'l Application No. PCT/FR01/03210.

* cited by examiner

*Primary Examiner* — Brian P Mruk
(74) *Attorney, Agent, or Firm* — Hunton & Williams LLP

(57) ABSTRACT

The invention concerns a composition for cotton textile care in particular, comprising an anionic polysaccharide (in particular anionic polygalactomannan) having a mole weight higher than 250000. The composition can be a solid or liquid detergent formulation, a liquid rinsing and/or softening formulation, a drying additive contacted with wet textile in a dry textile, an aqueous ironing formulation, a prespotting washing additive deposited on the textile before a washing operation.

24 Claims, No Drawings

PROCESS FOR PROTECTING THE COLORS OF COLORED TEXTILE ARTICLES OR FOR PROVIDING CREASE RESISTANCE TO TEXTILE ARTICLES

CROSS-REFERENCE TO RELATED APPLICATIONS

This application is a continuation of U.S. application Ser. No. 12/166,941, filed Jul. 2, 2008, now abandoned, which is a continuation of U.S. application Ser. No. 11/787,089 filed Apr. 13, 2007, now abandoned, which is a continuation of U.S. application Ser. No. 10/399,652 filed Apr. 18, 2003, now abandoned, which is the U.S. National Phase Application of International Application No. PCT/FR01/03210 filed Oct. 17, 2001, which claims the benefit of French Application No. FR 00/13334, filed Oct. 18, 2000, the disclosures of each of which are incorporated by reference in their entirety.

The present invention relates to a composition comprising an anionic polysaccharide, for caring for articles made of textile fibers ("textile care"), especially cotton-based textiles, which are in particular colored.

The expression "care of articles made of textile fibers, in particular fabrics" means the protection of these articles against physical or chemical degradation phenomena, especially the protection of the colors of colored articles, and/or the provision of benefits thereto, for instance softening and/or crease-resistance properties.

The machine washing of fabrics leads to a physical and chemical degradation of the fibers and most particularly of cotton fibers. The alkalinity delivered by detergents and also by certain specific compounds such as oxidizing substances (perborate or percarbonate) or certain enzymes may be the cause of the chemical degradation of cotton fibers. However, it is generally the combination of the chemical and mechanical actions which leads to degradation of the fibers. The mechanical action is produced during the washing, rinsing, spin-drying or tumble-drying, when the latter takes place in a tumble dryer. This degradation of the fibers leads to the formation of fibrils at the surface of the textile which end up causing colored textiles to lose their radiance. This degradation also induces a decrease in the strength of the textile which, at the extreme, may lead to tearing of the fabrics. This degradation of the textiles may be evaluated quantitatively either by a loss of the colors of colored textiles or by a reduction in the tear strength of the textile. It is generally necessary to carry out 10 to 20 cumulative machine washes in order to perceive this type of degradation.

Cleaning in a washing machine, which systematically includes a spin-drying operation, also leads to creased fabrics, which is accentuated during the tumble-drying stage, in particular by the formation of inter-fiber hydrogen bonds. It is thus necessary to iron the fabrics in order to make them look presentable.

In order to reduce the degradation of the fibers during washing or rinsing, the suppliers of chemical products or detergents have made use of changes in detergent formulations or have used certain specific additives.

Mention may be made in particular of detergents comprising no oxidizing system, but which have reduced cleaning capacities.

Silicone-based compounds have also been used, and in particular aminosilicones (U.S. Pat. No. 4,585,563; WO 92/07927; WO 98/39401).

The Applicant has found that the use, in compositions for treating articles made of textile fibers, especially cotton-based articles, which are in particular colored, of certain anionic polysaccharides of high molecular mass that are soluble under the working conditions in aqueous or wet medium of said compositions, makes it possible to prevent the degradation of these articles, makes it possible to protect the colors and/or gives these articles crease-resistance and/or softening properties.

Such compositions may especially be compositions for washing and/or rinsing and/or softening fabrics, for destaining fabrics before washing ("prespotting"), for tumble-drying wet fabrics in a tumble dryer or for ironing fabrics.

A first subject of the invention consists of a composition for caring for articles made of textile fibers ("fabric care"), characterized in that it comprises at least one anionic polysaccharide with a weight-average molar mass of greater than 250 000 and preferably greater than 500 000, the native skeleton of which is a polysaccharide formed from

- a main chain comprising identical or different anhydrohexose units, and
- branches comprising at least one neutral or anionic anhydropentose and/or anhydrohexose unit the anhydrohexose and/or anhydropentose units of said anionic polysaccharide being substituted or modified with at least one anionic group or a group that may be anionized at the working pH of said composition, the degree of substitution or of modification DSi of the anhydrohexose and/or anhydropentose units with said anionic or anionizable group(s) ranging from 0.1 to less than 3 and preferably from 0.2 to 2.5.

The weight-average molar mass of said anionic polysaccharides may be up to 2 000 000.

The weight-average molar mass of said anionic polysaccharides may be measured by size exclusion chromatography. The measurement is performed in water at pH 9-10 containing 0.1 M LiCl and 2/10000 of $NaN_3$.

The weight-average molar mass Mw is established directly in a manner that is known via the light-scattering values.

The degree of substitution or of modification DSi corresponds to the average number of hydroxyl functions in the anhydrohexose and/or anhydropentose units that are substituted or modified with said anionic or anionizable group(s), per anhydrohexose and/or anhydropentose unit.

Said ionic or ionizable groups are linked to the carbon atoms of the sugar skeleton either directly or via —O— bonds.

According to one embodiment variant of the invention, said anionic polysaccharide may also contain at least one nonionic group.

Said nonionic groups are linked to the carbon atoms of the sugar skeleton either directly or via —O— bonds.

The presence of such groups is expressed as the number of moles of substitution MS, i.e. as the average number of moles of precursor of said nonionic substituent that have reacted per anhydrohexose and/or anhydropentose unit.

If said precursor is incapable of forming new reactive hydroxyl groups (for example alkylation precursor), the degree of substitution or of modification by all the anionic or anionizable and nonionic groups is less than 3, by definition.

If said precursor is capable of forming new reactive hydroxyl groups (for example hydroxyalkylation precursor), the number of moles of substitution MS is theoretically not limited; it may be, for example, up to 6 and preferably up to 2.

Among the anionic or anionizable groups that may be mentioned are those containing one or more carboxylate, sulfonate, sulfate, phosphate, phosphonate, etc. functions.

Mention may be made in particular of those of formula $$—[—CH_2—CH(R)—O]_x—(CH_2)_y—COOH$$

or $$[—CH_2—CH(R)—O]_x—(CH_2)_y—COOM$$

in which:

R is a hydrogen atom or an alkyl radical containing from 1 to 4 carbon atoms, x is an integer ranging from 0 to 5, y is an integer ranging from 0 to 5, M represents an alkali metal.

Mention may be made most particularly of the carboxyl groups $—COO^-Na^+$ linked directly to a carbon atom of the sugar skeleton, carboxymethyl (sodium salt) $—CH_2—COO^-Na^+$ linked to a carbon atom of the sugar skeleton via an —O— bond.

Among the nonionic groups that may be mentioned are those of formula:

$$—[—CH_2—CH(R)—O]_x—R^1$$

in which:

R is a hydrogen atom or an alkyl radical containing from 1 to 4 carbon atoms, x is an integer ranging from 0 to 5, $R^1$ represents:

a hydrogen atom an alkyl radical containing from 1 to 22 carbon atoms, optionally interrupted with one or more oxygen and/or nitrogen hetero atoms, cycloalkyl, aryl or arylalkyl, containing from 6 to 12 carbon atoms, a radical $—(CH_2)_y—COOR^2$ a radical $—(CH_2)_y—CN$ a radical $—(CH_2)_y—CONHR^2$ $R^2$ representing an alkyl, aryl or arylalkyl radical containing from 1 to 22 carbon atoms, and y is an integer ranging from 0 to 5

$$—CO—NH—R^1$$

$R^1$ having the definition given above, linked to a carbon atom of the sugar skeleton via an —O— bond.

Mention may be made most particularly of the following groups:

methyl, ethyl, propyl, isopropyl, butyl, hexyl, octyl, dodecyl, octadecyl, phenyl, benzyl, linked to a carbon atom of the sugar skeleton via an ether, ester, amide or urethane bond, cyanoethyl, hydroxyethyl, hydroxypropyl, hydroxybutyl, linked to a carbon atom of the sugar skeleton via an —O— bond.

The hexose units (identical or different) of the main chain of the native skeleton may be D-glucose, D- or L-galactose, D-mannose, D- or L-fucose, L-rhamnose, etc. units.

The neutral or anionic pentose and/or hexose units (identical or different) of the branches of the native skeleton may be D-xylose, L- or D-arabinose, D-glucose, D- or L-galactose, D-mannose, D- or L-fucose, L-rhamnose, etc., D-glucuronic acid, D-galacturonic acid, D-mannuronic acid, etc. units.

Examples of native skeletons that may be mentioned include galactomannans, galactoglucomannans, xyloglucans, xanthan gums, scleroglucans, succinoglycans, rhamsans, welan gums, etc.

The native skeleton is preferably a galactomannan. Galactomannans are macromolecules comprising a main chain of D-mannopyranose units linked in position β(1-4) substituted with D-galactopyranose units in position α(1-6). Among these, mention may be made of guar gum, carob gum and tara gum.

The native skeleton is most preferably a guar gum. Guar gums have a mannose/galactose ratio of 2.

The anionic polysaccharides according to the invention may be obtained in a known manner.

Most of them are commercial products.

Examples of anionic polysaccharides according to the invention that may be mentioned include:

carboxymethyl galactomannans, in particular carboxymethyl guars, carboxymethyl hydroxypropyl galactomannans, in particular carboxymethyl hydroxypropyl guars.

A second subject of the invention consists of a process for caring for articles made of textile fibers, by treating these articles with a composition, in aqueous or wet medium, comprising at least one anionic polysaccharide according to the invention.

A third subject of the invention consists in using, in a composition for treating articles made of textile fibers in an aqueous or wet medium, of at least one anionic polysaccharide according to the invention, as an agent for caring for textile fibers.

The composition and the working (or treatment) conditions may be in numerous forms.

Said composition may be in the form of a solid (powder, granules, tablets, etc.) or of a dispersion or of a concentrated aqueous solution placed in contact with the articles to be treated, after dilution in water;

in the form of a dispersion or a concentrated aqueous solution placed beforehand on the dry articles to be treated before dilution in water;

in the form of a dispersion or an aqueous solution to be placed directly on the dry articles to be treated without dilution or of a solid support (stick) comprising said anionic polysaccharide, to be applied directly to the dry articles to be treated;

in the form of an insoluble solid support comprising said anionic polysaccharide placed directly in contact with the wet fabrics to be treated.

Thus, the composition of the invention may be:

a solid or liquid detergent formulation capable of directly forming a washing bath by dilution;

a liquid rinsing and/or softening formulation capable of directly forming a rinsing and/or softening bath by dilution;

a solid material, in particular a textile, comprising said anionic polysaccharide, which is intended to be placed in contact with wet fabrics in a tumble dryer (said solid material is referred to hereinbelow as a "tumble dryer additive");

an aqueous ironing formulation;

a washing additive ("prespotter") intended to be placed on the dry fabrics prior to a washing operation using a detergent formulation containing or not containing said anionic polysaccharide (said additive is referred to hereinbelow as a "prespotter").

The composition of the invention is particularly suitable for fabric care, especially for cotton-based fabrics, in particular fabrics containing at least 35% cotton. It is most particularly suitable for caring for colored fabrics.

The anionic polysaccharides according to the invention are soluble under the working conditions in aqueous or wet medium of said composition.

Said anionic polysaccharides are considered as soluble when more than 50% and preferably more than 70% of their weight are soluble in the working aqueous or wet medium of the composition of the invention, i.e. especially under the temperature and pH conditions of said medium.

The working pH of the composition of the invention may range from about 2 to about 12, depending on the desired use.

When it is:

- a detergent formulation, the pH of the washing bath is generally from about 7 to 11 and preferably from 8 to 10.5;
- a rinsing and/or softening formulation, the pH of the rinsing and/or softening bath is generally from about 2 to 8;
- a drying additive, the pH to be considered is that of the residual water, which may be from about 2 to 9;
- an aqueous ironing formulation, the pH of said formulation is generally from about 5 to 9;
- a prespotter, the pH to be considered is that of the washing bath for the operation following washing, i.e. from about 7 to 11 and preferably from 8 to 10.5.

The amount of anionic polysaccharide present in the care composition according to the invention may range from 0.05% to 10% as dry weight relative to the dry weight of said composition, depending on the desired application.

Thus, said anionic polysaccharide (AP) may be used as follows:

| % of (AP) (as dry weight) | in a care composition according to the invention used as |
|---|---|
| 0.05-5<br>preferably 0.1-3 | detergent formulation |
| 0.05-3<br>preferably 0.1-2 | rinsing and/or softening formulation |
| 0.05-10 | tumble dryer additive |
| 0.05-10<br>preferably 0.1-5 | ironing formulation |
| 0.05-10<br>preferably 0.1-5 | prespotter |

Other constituents may be present, along with the anionic polysaccharide, in the care composition according to the invention. Said composition may contain at least one surfactant and/or one detergent additive and/or rinsing additive and/or softening additive for articles made of textile fibers and/or one solid support (especially a textile support) for said anionic polysaccharide.

The nature of these constituents depends on the desired use of said composition.

Thus, when it is a detergent formulation, for washing fabrics, it generally comprises:

at least one natural and/or synthetic surfactant,
at least one detergent adjuvant ("builder")
optionally an oxidizing agent or system, and
a series of specific additives.

The detergent formulation may comprise surfactants in an amount corresponding to about 3% to 40% by weight relative to the detergent formulation, these surfactants being such as Anionic Surfactants alkyl ester sulfonates of formula R—CH($SO_3$M)—COOR', in which R represents a $C_8$-$C_{20}$ and preferably $C_{10}$-$C_{16}$ alkyl radical, R' represents a $C_1$-$C_6$ and preferably $C_1$-$C_3$ alkyl radical and M represents an alkali metal (sodium, potassium or lithium) cation, a substituted or unsubstituted ammonium (methyl-, dimethyl-, trimethyl- or tetramethylammonium, dimethylpiperidinium, etc.) or an alkanolamine derivative (monoethanolamine, diethanolamine, triethanolamine, etc.). Mention may be made most particularly of methyl ester sulfonates in which the radical R is $C_{14}$-$C_{16}$;

alkyl sulfates of formula R$OSO_3$M, in which R represents a $C_5$-$C_{24}$ and preferably $C_{10}$-$C_{18}$ alkyl or hydroxyalkyl radical, M representing a hydrogen atom or a cation of the same definition as above, and also the ethoxylenated (EO) and/or propoxylenated (PO) derivatives thereof, containing on average from 0.5 to 30 and preferably from 0.5 to 10 EO and/or PO units;

alkylamide sulfates of formula RCONHR'$OSO_3$M in which R represents a $C_2$-$C_{22}$ and preferably. $C_6$-$C_{20}$ alkyl radical, R' represents a $C_2$-$C_3$ alkyl radical, M representing a hydrogen atom or a cation of the same definition as above, and also the ethoxylenated (EO) and/or propoxylenated (PO) derivatives thereof, containing on average from 0.5 to 60 EO and/or PO units;

saturated or unsaturated $C_8$-$C_{24}$ and preferably $C_{14}$-$C_{20}$ fatty acid salts, $C_9$-$C_{20}$ alkylbenzenesulfonates, primary or secondary $C_9$-$C_{22}$ alkylsulfonates, alkylglyceryl sulfonates, the sulfonated polycarboxylic acids described in GB-A-1 082 179, paraffin sulfonates, N-acyl N-alkyltaurates, alkyl phosphates, isethionates, alkyl succinamates, alkyl sulfosuccinates, sulfosuccinate monoesters or diesters, N-acyl sarcosinates, alkylglycoside sulfates, polyethoxycarboxylates; the cation being an alkali metal (sodium, potassium or lithium), a substituted or unsubstituted ammonium residue (methyl-, dimethyl-, trimethyl- or tetramethylammonium, dimethylpiperidinium, etc.) or an alkanolamine derivative (monoethanolamine, diethanolamine, triethanolamine, etc.);

Nonionic Surfactants polyoxyalkylenated (polyoxyethylenated, polyoxypropylenated or polyoxybutylenated) alkylphenols in which the alkyl substituent is $C_6$-$C_{12}$ and containing from 5 to 25 oxyalkylene units; examples which may be mentioned are the products Triton X-45, X-114, X-100 or X-102 sold by Rohm & Haas Co.;

glucosamide, glucamide or glycerolamide;

polyoxyalkylenated $C_8$-$C_{22}$ aliphatic alcohols containing from 1 to 25 oxyalkylene (oxyethylene or oxypropylene) units; examples which may be mentioned are the products Tergitol 15-S-9 and Tergitol 24-L-6 NMW sold by Union Carbide Corp., Neodol 45-9, Neodol 23-65, Neodol 45-7 and Neodol 45-4 sold by Shell Chemical Co., and Kyro EOB sold by The Procter & Gamble Co.;

products resulting from the condensation of ethylene oxide or the compound resulting from the condensation of propylene oxide with propylene glycol, such as the Pluronic products sold by BASF;

products resulting from the condensation of ethylene oxide or the compound resulting from the condensation of propylene oxide with ethylenediamine, such as the Tetronic products sold by BASF;

amine oxides such as $C_{10}$-$C_{18}$ alkyl dimethylamine oxides and $C_8$-$C_{22}$ alkoxy ethyl dihydroxyethylamine oxides;

the alkylpolyglycosides described in U.S. Pat. No. 4,565,647;

$C_8$-$C_{20}$ fatty acid amides;

ethoxylated fatty acids;

ethoxylated fatty amides;

ethoxylated amines.

Amphoteric and Zwitterionic Surfactants alkyldimethylbetaines, alkylamidopropyldimethylbetaines, alkyltrimethylsulfobetaines and the products of condensation of fatty acids and of protein hydrolysates;

alkyl amphoacetates or alkyl amphodiacetates in which the alkyl group contains from 6 to 20 carbon atoms.

The detergent adjuvants ("builders") for improving the surfactant properties may be used in amounts corresponding to about 5-50% and preferably to about 5-30% by weight for the liquid detergent formulations or to about 10-80% and preferably 15-50% by weight for the powder detergent formulations, these detergent adjuvants being such as:

Mineral Detergent Adjuvants polyphosphates (tripolyphosphates, pyrophosphates, orthophosphates or hexametaphosphates) of alkali metals, of ammonium or of alkanolamines tetraborates or borate precursors;

silicates, in particular those with an $SiO_2/Na_2O$ ratio from about 1.6/1 to 3.2/1 and the lamellar silicates described in U.S. Pat. No. 4,664,839;

alkali metal or alkaline-earth metal carbonates (bicarbonates, sesquicarbonates);

cogranulates of alkali metal silicate hydrates and of alkali metal (sodium or potassium) carbonates that are rich in silicon atoms in Q2 or Q3 form, described in EP-A-488 868;

crystalline or amorphous aluminosilicates of alkali metals (sodium or potassium) or of ammonium, such as zeolites A, P, X, etc.; zeolite A with a particle size of about 0.1-10 micrometers is preferred.

Organic Detergent Adjuvants water-soluble polyphosphonates (ethane 1-hydroxy-1,1-diphosphonates, methylenediphosphonate salts, etc.);

water-soluble salts of carboxylic polymers or copolymers or water-soluble salts thereof, such as:

polycarboxylate ethers (oxydisuccinic acid and its salts, monosuccinic acid tartrate and its salts, disuccinic acid tartrate and its salts);

hydroxypolycarboxylate ethers;

citric acid and its salts, mellitic acid and succinic acid and their salts;

polyacetic acid salts (ethylenediaminetetraacetates, nitrilotriacetates, N-(2-hydroxyethyl)nitrilodiacetates);

$C_5$-$C_{20}$ alkyl succinic acids and their salts (2-dodecenylsuccinates, lauryl succinates);

carboxylic polyacetal esters;

polyaspartic acid and polyglutamic acid and their salts;

polyimides derived from the polycondensation of aspartic acid and/or of glutamic acid;

polycarboxymethyl derivatives of glutamic acid or of other amino acids.

The detergent formulation may also comprise at least one oxygen-releasing bleaching agent comprising a percompound, preferably a persalt.

Said bleaching agent may be present in an amount corresponding to about 1% to 30% and preferably from 4% to 20% by weight relative to the detergent formulation.

As examples of percompounds which may be used as bleaching agents, mention should be made in particular of perborates such as sodium perborate monohydrate or tetrahydrate; peroxygenated compounds such as sodium carbonate peroxyhydrate, pyrophosphate peroxyhydrate, urea peroxyhydrate, sodium peroxide and sodium persulfate.

The preferred bleaching agents are sodium perborate monohydrate or tetrahydrate and/or sodium carbonate peroxyhydrate.

Said agents are generally combined with a bleaching activator which generates, in situ in the washing medium, a peroxycarboxylic acid in an amount corresponding to about 0.1% to 12% and preferably from 0.5% to 8% by weight relative to the detergent formulation. Among these activators, mention may be made of tetraacetylethylenediamine, tetraacetylmethylenediamine, tetraacetylglycoluryl, sodium p-acetoxybenzenesulfonate, pentaacetylglucose and octaacetyllactose.

Mention may also be made of non-oxygenated bleaching agents, which act by photoactivation in the presence of oxygen, these being agents such as sulfonated aluminum and/or zinc phthalocyanins.

The detergent formulation may also comprise soil-release agents, anti-redeposition agents, chelating agents, dispersants, fluorescers, foam suppressants, softeners, enzymes and various other additives.

Soil-Release Agents

These may be used in amounts of about 0.01-10%, preferably about 0.1-5% and more preferably about 0.2-3% by weight.

Mention may be made more particularly of agents such as:

cellulose derivatives such as cellulose hydroxy ethers, methylcellulose, ethylcellulose, hydroxypropylmethylcellulose or hydroxybutylmethylcellulose;

polyvinyl esters grafted onto polyalkylene trunks, such as polyvinyl acetates grafted onto polyoxyethylene trunks (EP-A-219 048);

polyvinyl alcohols;

polyester copolymers based on ethylene terephthalate and/or propylene terephthalate and polyoxyethylene terephthalate units, with an ethylene terephthalate and/or propylene terephthalate (number of units)/polyoxyethylene terephthalate (number of units) molar ratio from about 1/10 to 10/1 and preferably from about 1/1 to 9/1, the polyoxyethylene terephthalates containing polyoxyethylene units with a molecular weight from about 300 to 5 000 and preferably from about 600 to 5 000 (U.S. Pat. No. 3,959,230, U.S. Pat. No. 3,893,929, U.S. Pat. No. 4,116,896, U.S. Pat. No. 4,702,857, U.S. Pat. No. 4,770,666);

sulfonated polyester oligomers obtained by sulfonation of an oligomer derived from ethoxylated allylic alcohol, from dimethyl terephthalate and from 1,2-propylene diol, containing from 1 to 4 sulfonated groups (U.S. Pat. No. 4,968,451);

polyester copolymers based on propylene terephthalate and polyoxyethylene terephthalate units and ending with ethyl or methyl units (U.S. Pat. No. 4,711,730) or polyester oligomers ending with alkylpolyethoxy groups (U.S. Pat. No. 4,702,857) or sulfopolyethoxy (U.S. Pat. No. 4,721,580) or sulfoaroyl (U.S. Pat. No. 4,877,896) anionic groups;

sulfonated polyester copolymers derived from terephthalic, isophthalic and sulfoisophthalic acid, anhydride or diester and from a diol (FR-A-2 720 399).

Anti-Redeposition Agents

These may be used in amounts generally of about 0.01-10% by weight for a powder detergent formulation of about 0.01-5% by weight for a liquid detergent formulation.

Mention may be made in particular of agents such as:

ethoxylated monoamines or polyamines, and ethoxylated amine polymers (U.S. Pat. No. 4,597,898, EP-A-11 984);

carboxymethylcellulose;

sulfonated polyester oligomers obtained by condensation of isophthalic acid, dimethyl sulfosuccinate and diethylene glycol (FR-A-2 236 926);

polyvinylpyrrolidones.

Chelating Agents

Agents for chelating iron and magnesium may be present in amounts of about 0.1-10% and preferably of about 0.1-3% by weight.

Mention may be made, inter alia, of:

aminocarboxylates such as ethylenediaminetetraacetates, hydroxyethylethylenediaminetriacetates and nitrilotriacetates;

aminophosphonates such as nitrilotris(methylenephosphonates);

polyfunctional aromatic compounds such as dihydroxydisulfobenzenes.

Polymeric Dispersants

These may be present in an amount of about 0.1-7% by weight, to control the calcium and magnesium hardness, these being agents such as:

water-soluble polycarboxylic acid salts with a molecular mass from about 2 000 to 100 000, obtained by polymerization or copolymerization of ethylenically unsaturated carboxylic acids such as acrylic acid, maleic acid or anhydride, fumaric acid, itaconic acid, aconitic acid, mesaconic acid, citraconic acid or methylenemalonic acid, and most particularly polyacrylates with a molecular mass from about 2 000 to 10 000 (U.S. Pat. No. 3,308,067), copolymers of acrylic acid and of maleic anhydride with a molecular mass from about 5 000 to 75 000 (EP-A-66 915);

polyethylene glycols with a molecular mass from about 1 000 to 50 000.

Fluorescers (Brighteners)

These may be present in an amount of about 0.05-1.2% by weight, these being agents such as: stilbene, pyrazoline, coumarin, fumaric acid, cinnamic acid, azole, methinecyanin, thiophene, etc. derivatives ("The production and application of fluorescent brightening agents"—M. Zahradnik, published by John Wiley & Sons, New York, 1982).

Foam Suppressants

These may be present in amounts which may be up to 5% by weight, these being agents such as:

$C_{10}$-$C_{24}$ monocarboxylic fatty acids or alkali metal, ammonium or alkanolamine salts thereof, and fatty acid triglycerides;

saturated or unsaturated aliphatic, alicyclic, aromatic or heterocyclic hydrocarbons, such as paraffins and waxes;

N-alkylaminotriazines;

monostearyl phosphates and monostearyl alkyl phosphates;

polyorganosiloxane oils or resins optionally combined with silica particles.

Softeners

These may be present in amounts of about 0.5-10% by weight, these being agents such as clays.

Enzymes

These may be present in an amount which may be up to 5 mg by weight and preferably of about 0.05-3 mg of active enzyme/g of detergent formulation, these being enzymes such as:

proteases, amylases, lipases, cellulases and peroxidases (U.S. Pat. No. 3,553,139, U.S. Pat. No. 4,101,457, U.S. Pat. No. 4,507,219, U.S. Pat. No. 4,261,868).

Other Additives

Mention may be made, inter alia, of:

buffers, fragrances, pigments.

The detergent formulation may be used, in particular in a washing machine, in a proportion of from 0.5 g/l to 20 g/l and preferably from 2 g/l to 10 g/l to carry out washing operations at a temperature from about 25 to 90° C.

A second embodiment of the care composition of the invention consists of an aqueous liquid formulation for rinsing and/or softening fabrics.

It may be used in a proportion of from 0.2 to 10 g/l and preferably from 2 to 10 g/l.

Along with the anionic polysaccharide, there may be present other constituents of the type such as:

combinations of cationic surfactants (triethanolamine diester quaternized with dimethyl sulfate, N-methylimidazoline tallow ester methyl sulfate, dialkyldimethylammonium chloride, alkylbenzyldimethylammonium chloride, methyl alkylimidazolinium sulfate, methyl methylbis (alkylamidoethyl)-2-hydroxyethylammonium sulfate, etc.) in an amount which may range from 3% to 50% and preferably from 4% to 30% of said formulation, optionally combined with nonionic surfactants (ethoxylated fatty alcohols, ethoxylated alkylphenols, etc.) in an amount which may be up to 3%;

optical brighteners (0.1% to 0.2%);

optionally, color-fast agents (polyvinylpyrrolidone, polyvinyloxazolidone, polymethacrylamide, etc. 0.03% to 25% and preferably 0.1% to 15%), colorants, fragrances, solvents, in particular alcohols (methanol, ethanol, propanol, isopropanol, ethylene glycol or glycerol), foam limiters.

A third embodiment of the care composition of the invention consists of an additive for drying fabrics in a suitable tumble dryer.

Said additive comprises a flexible solid support consisting, for example, of a strip of woven or nonwoven textile or a sheet of cellulose, impregnated with said anionic polysaccharide; said additive is introduced at the time of tumble-drying into the wet fabrics to be dried at a temperature from about 50 to 80° C. for 10 to 60 minutes.

Said additive may also comprise cationic softeners (up to 99%) and color-fast agents (up to 80%), such as those mentioned above.

A fourth embodiment of the care composition of the invention consists of an ironing formulation which may be sprayed directly onto the dry fabrics before ironing.

Said formulation may also contain silicone-based polymers (from 0.2% to 5%), nonionic surfactants (from 0.5% to 5%) or anionic surfactants (from 0.5% to 5%), fragrances (0.1% to 3%) or cellulose derivatives (0.1% to 3%), for instance starch; spraying said formulation onto the fabrics makes it easier to iron them and limits the creasing of the fabrics when they are worn.

A fifth embodiment of the care composition of the invention consists of a prespotter which is in the form of an aqueous solution or dispersion or a solid (stick).

Along with the anionic polysaccharide, there may be present other constituents of the type such as:

anionic surfactants such as those already mentioned above, in an amount of at least 5% of the weight of the composition nonionic surfactants such as those already mentioned above, in an amount which may range from 15% to 40% of the weight of the composition aliphatic hydrocarbons, in an amount which can range from 5% to 20% of the weight of the composition.

The examples that follow are given for illustrative purposes.

The anionic polysaccharide used in the examples below is a carboxymethyl guar with a degree of substitution of 1.6 and a weight-average molar mass of 1 400 000, determined as follows by size exclusion chromatography.

The measurement is performed in water at pH 9-10 containing 0.1 M LiCl and 2/10000 of $NaN_3$. The characteristics of the machine are as follows:

chromatography columns: 3 Shodex SB806HQ 30 cm, 5 μm columns injector-pump: JASCO pump detector: RI Waters 410 refractometer Sensitivity 8, MALLS Wyatt light scattering, 633 nm He laser flow rate: 0.8 ml/min.

The injected solution (200 μl) contains about 0.5% by weight of anionic polysaccharide. The weight-average molecular mass is established directly without calibration using the light scattering values extrapolated to zero angle; these values are proportional to $C \times M \times (dn/dc)^2$.

C corresponds to the polysaccharide concentration

M corresponds to the weight-average molecular mass n corresponds to the optical index of the solution c corresponds to the polysaccharide concentration the ratio dn/dc is equal here to 0.140

EXAMPLE 1

Detergent Formulation

| Constituents | Formulation (A) with P % by weight | (B) color without P % by weight | (C) without P % by weight |
|---|---|---|---|
| NaTPP | 40 | | |
| Zeolite 4A | 0 | 25 | 25 |
| 2 $SiO_2$, $Na_2O$ silicate | 5 | 5 | 5 |
| Sodium carbonate | 5 | 15 | 15 |
| Acrylate/maleate copolymer Sokalan CP5 (BASF) | 0 | 5 | 5 |
| Sodium sulfate | 8 | 21 | 8 |
| CMC blanose 7MXF (Hercules) | 1 | 1 | 1 |
| Perborate monohydrate | 15 | 0 | 15 |
| Granulated TAED | 5 | 0 | 5 |
| Anionic surfactant Laurylbenzene sulfate (Nansa) | 6 | 8 | 6 |
| Nonionic surfactant Symperonic A3 (3 EO ethoxylated alcohol-ICI) | 3 | 5 | 3 |
| Nonionic surfactant Symperonic A9 (9 EO ethoxylated alcohol-ICI) | 9 | 11 | 9 |
| Enzymes (esterases, amylases, cellulase, protease) | 0.5 | 0.5 | 0.5 |
| Fragrances | 1 | 1 | 1 |
| Anionic polysaccharide (% solids) | 1.0 | 1.0 | 1.0 |
| Polyvinylpyrrolidone | 0 | 1 | 0 |
| Soil-release sulfonated Copolyester Repel-O-Tex PF 594 from Rhodia | 0.5 | 0.5 | 0.5 |

A washing operation is carried out in a Tergotometer laboratory machine which is well known in the profession to detergent composition formulators. The machine simulates the mechanical and thermal effects of pulsating-type American washing machines, but, by virtue of the presence of 6 washing drums, it makes it possible to carry out simultaneous series of tests with an appreciable saving in time.

25×25 cm test pieces are cut from unfinished cotton.

The cotton test pieces are first ironed so that they all have the same level of creasing before washing.

They are then washed using the above detergent formulation containing the anionic polysaccharide and rinsed once, under the following conditions:

number of test pieces per Tergotometer drum: 2 volume of water: 1 liter water of French hardness 30° TH obtained by suitable dilution of Contrexéville® brand mineral water washing product concentration: 5 g/l washing temperature: 40° C.

washing time: 20 min spin speed of the Tergotometer: 100 rpm rinsing with cold water (about 30° TH)

rinsing time: 5 minutes

The test pieces are then creased under a 3 kg press for 20 seconds, after which they are dried vertically overnight.

The same operation is carried out using the same detergent formulation, but free of the anionic polysaccharide.

A digital color photograph is then taken of the dry test pieces, which is then converted into 256 gray scale levels (gray scale from 0 to 255).

The number of pixels corresponding to each gray scale level are counted.

For each histogram obtained, the standard deviation σ of the distribution of the gray scale level is measured.

σ1 corresponds to the standard deviation obtained with the detergent formulation containing no anionic polysaccharide.

σ2 corresponds to the standard deviation obtained with the detergent formulation containing the anionic polysaccharide.

The performance value is given by the equation $$-\Delta\sigma = \sigma 2 - \sigma 1$$

The performance values obtained are as follows:

| Formulation | (A) | (B) | (C) |
|---|---|---|---|
| $-\Delta\sigma$ | 3.5 | 4 | 4.5 |

These positive values of $-\Delta\sigma$ are representative of a crease-resistance property provided by the detergent formulation comprising the anionic polysaccharide according to the invention.

EXAMPLE 2

Rinsing/Softening Formulation

| Constituents | % by weight |
|---|---|
| Cationic surfactant: ditallow dimethylammonium chloride | 5% |
| Fragrance | 1% |
| HCl to obtain a pH = 3 | 0.2% |
| Anionic polysaccharide (% solids) | 2% |

EXAMPLE 3

Measurement of the Protection of Colors

Principle

This consists in forming, under defined conditions, 10 washes of a sample of several colored cotton fabrics. The color protection efficacy is tested in an automatic washing machine. The actual assessment is performed by a reflectance measurement. The fabrics are examined before and after 10 washes. The variation in color thus recorded (ΔE*) constitutes the loss of color on each type of fabric.

Apparatus—Reagents

AEG Lavamat 2050 Turbo automatic washing machine: Commercial front-loading washing machine—wash cycles at 40° C.—volume of washing water: 13 liters Recorded program: 10 wash cycles LUCI100 reflectometer—Dr Lange: This is a reflectance machine used for measuring the colors of fabrics before and after washing.

6 tea towels: made of gray cotton cloth referenced 402MBLI (from D. PORTHAULT SA)

4 towels (as ballast): plush-loop white cotton terry towel 500 g/m$^2$ (from D. PORTHAULT SA)

Sampling of 5 different commercial colored fabrics pink woven cotton
violet woven cotton
blue woven cotton
green woven cotton
orange woven cotton Procedure Washing Conditions:

Wash temperature: 40° C.

Duration: about 67 min

Number of washes: 10

Laundry load: 3 kg dry weight (4 towels+6 tea cloths+colored fabrics)

Bath volume: 13 liters±1 liter

Water hardness: about 23° TH French

Washing formula concentration: 5±0.1 g/l

Procedure: 5 Steps

Measurement of the color of the new fabric samples

Sewing of the colored fabric samples to the tea cloths in order to avoid fraying during the successive washes Implementation of the 10 washes without drying between the cycles Drying in open air Measurement of colors on the washed fabrics The colors are measured on a LUCI100 reflectometer:

The measuring system used is the CIE [International Commission on Illumination]—L* a* b* (DIN6174, CIE-LAB 1976).

It is made up as follows:

L* corresponds to the degree of whiteness on a white-black scale.

L*=100 for a white sample

L*=0 for a black sample a* positions the color in a range from green to red.

a*≧0 the color tends toward red.

a*≦0 the color tends toward green.

b* positions the color in a range from yellow to blue.

b*≧0 the color tends toward yellow.

b*≦0 the color tends toward blue.

Each sample of fabric is measured at 5 different points (one at the center and one in each corner) and the average of the components L*, a* and b* is calculated.

Exploiting the Results:

The reflectometer is equipped with software that indirectly calculates the ΔE* from the data previously recorded. This value corresponds to the color variation recorded on the fabric after washing and is expressed as follows:

$$\Delta L^* = L^*_{after\ washing} - L^*_{before\ washing}$$

$$\Delta a^* = a^*_{after\ washing} - a^*_{before\ washing}$$

$$\Delta b^* = b^*_{after\ washing} - b^*_{before\ washing}$$

The loss of color for each fabric is then given by the follow expression:

$$\Delta E^1 = \sqrt{(\Delta L^1)^2 + (\Delta a^1)^2 + (\Delta b^1)^2}$$

The performance quality of the polysaccharide relative to the reference is measured as the difference in ΔE* between the formulae without and with polysaccharide.

The cumulative loss of color is calculated as the sum of the losses of color of the colored fabrics.

A detergent formulation (F) is prepared by adding 1 part of anionic polysaccharide to 100 parts of composition (C) below (expressed in parts by weight):

| | |
|---|---|
| sodium lauryl alkyl benzene sulfonate | 19.2 |
| Nabion 15 from Rhodia (cogranules of sodium silicate and of calcium carbonate) | 48.6 |
| sodium carbonate | 10.3 |
| sodium sulfate | 13.5 |
| Sokalan CP5 | 6.4 |
| Phosphonate Dequest 2016 | 2 |

This formulation (F) and the composition without anionic polysaccharide (C) are tested as described above.

The results obtained are as follows:

| fabric | (C) | (F) | Performance |
|---|---|---|---|
| pink | 20.20 | 12.21 | 7.99 |
| violet | 21.84 | 15.79 | 6.05 |
| blue | 2.56 | 1.56 | 1.00 |
| green | 10.99 | 9.04 | 1.95 |
| orange | 3.60 | 2.59 | 1.01 |
| cumulative loss of color ΔE | 59.19 | 41.19 | 18 |

These results show that the presence of anionic polysaccharide in the formulation (F) allows the protection of the colors to be improved substantially.

The invention claimed is:

1. A process for protecting the colors of colored textile articles or for providing crease-resistance to textile articles, comprising the step of applying to said articles a composition consisting essentially of at least one anionic polysaccharide with a weight-average molar mass of greater than 250,000 g/mole, the native skeleton of which is a polysaccharide comprising:

a main chain comprising identical or different anhydrohexose units, and branches comprising at least one neutral or anionic anhydropentose and/or anhydrohexose unit;

wherein the anhydrohexose or anhydropentose units of said anionic polysaccharide are substituted or modified with at least one group, said group comprising an anionic group or a group that is optionally anionized at the working pH of said composition;

the degree of substitution or of modification (DSi) of the anhydrohexose or anhydropentose units with said anionic or anionizable group(s) ranging from 0.1 to less than 3;

wherein said polysaccharide is anionic.

2. The process of claim 1, wherein the weight-average molar mass of the composition is greater than 500,000 g/mole, and the degree of substitution or of modification, DSi, ranges from 0.2 to 2.5.

3. The process of claim 1, wherein the anionic or anionizable group(s) of the composition are linked to the carbon atoms of the sugar skeleton either directly or via —O— bonds.

4. The process of claim 1, wherein the anionic or anionizable group(s) of the composition comprise one or more carboxylate, sulfonate, sulfate, phosphate or phosphonate functions.

5. The process of claim 1, wherein the anionic or anionizable group(s) of the composition have the formula:

$$-[-CH_2-CH(R)-O]_x-(CH_2)_y-COOH$$

or $$-[-CH_2-CH(R)-O]_x-(CH_2)_y-COOM$$

wherein:

R is a hydrogen atom or an alkyl radical having from 1 to 4 carbon atoms, x is an integer ranging from 0 to 5, y is an integer ranging from 0 to 5, and M represents an alkali metal.

6. The process of claim 1, wherein the anionic or anionizable group(s) of the composition comprise carboxyl groups ($-COO^-Na^+$) linked directly to a carbon atom of the sugar skeleton, or carboxymethyl (sodium salt) $-CH_2-COO^-Na^+$ linked to a carbon atom of the sugar skeleton via an —O— bond.

7. The process of claim 1, wherein the anionic polysaccharide of the composition further comprises at least one nonionic group.

8. The process of claim 7, wherein the nonionic groups of the composition are linked to the carbon atoms of the sugar skeleton either directly or via —O— bonds.

9. The process of claim 7, wherein the nonionic groups of the composition have the formula:

$$-[-CH_2-CH(R)-O]_x-R^1$$

wherein:

R is a hydrogen atom or an alkyl radical having from 1 to 4 carbon atoms;

x is an integer ranging from 0 to 5;

$R^1$ represents:

a hydrogen atom, an alkyl radical comprising from 1 to 22 carbon atoms, optionally interrupted with one or more oxygen and/or nitrogen hetero atoms, cycloalkyl, aryl or arylalkyl, comprising from 6 to 12 carbon atoms, a radical $-(CH_2)_y-COOR^2$, a radical $-(CH_2)_y-CN$, or a radical $-(CH_2)_y-CONHR_2$;

wherein $R^2$ represents an alkyl, aryl or arylalkyl radical comprising from 1 to 22 carbon atoms; and y is an integer ranging from 0 to 5, or $$-CO-NH-R^1$$

wherein $R^1$ has the definition given above, linked to a carbon atom of the sugar skeleton via an —O— bond.

10. The process of claim 8, wherein the nonionic groups of the composition comprise the following groups:

methyl, ethyl, propyl, isopropyl, butyl, hexyl, octyl, dodecyl, octadecyl, phenyl, benzyl, linked to a carbon atom of the sugar skeleton via an ether, ester, amide, urethane bond, cyanoethyl, hydroxyethyl, hydroxypropyl, or hydroxybutyl, linked to a carbon atom of the sugar skeleton via an —O— bond.

11. The process of claim 1, wherein the hexose units of the composition comprise D-glucose, D- or L-galactose, D-mannose, D- or L-fucose or L-rhamnose units, and further wherein the hexose units may be identical or different.

12. The process of claim 1, wherein the neutral or anionic pentose or hexose units of the composition of the branches of the native skeleton comprise D-xylose, L- or D-arabinose, D-glucose, D- or L-galactose, D-mannose, D- or L-fucose, L-rhamnose, D-glucuronic acid, D-galacturonic acid or D-mannuronic acid units, and further wherein the neutral or anionic pentose or hexose units may be identical or different.

13. The process of claim 1, wherein said native skeleton of the composition comprises a galactomannan, galactoglucomannan, xyloglucan, a xanthan gum, a scleroglucan, succinoglycans, a rhamsan or a welan gum.

14. The process of claim 13, wherein said native skeleton of the composition comprises a galactomannan.

15. The process of claim 14, wherein said anionic polysaccharide of the composition comprises a carboxymethyl galactomannan or a carboxymethyl hydroxypropyl galactomannan.

16. The process of claim 15, wherein said anionic polysaccharide of the composition comprises a carboxymethyl guar or a carboxymethyl hydroxypropyl guar.

17. The process of claim 1, wherein said composition is in the form of a solid, a dispersion or a concentrated aqueous solution, placed in contact with a fabric to be treated, after dilution in water;

a dispersion or a concentrated aqueous solution prespotted onto the dry fabric to be treated before dilution in water;

a dispersion or an aqueous solution to be placed directly onto the dry fabric to be treated without dilution or a solid support comprising said anionic polysaccharide, to be applied directly to the dry fabric to be treated; or an insoluble solid support comprising said anionic polysaccharide placed directly in contact with the fabric to be treated, while wet.

18. The process of claim 1, wherein said composition comprises from 0.05% to 10% of said anionic polysaccharide, expressed as dry matter.

19. The process of claim 1, wherein said composition is a solid or liquid detergent formulation comprising from 0.05% to 5% of said anionic polysaccharide, expressed as dry matter, capable of directly forming a washing bath by dilution;

a liquid rinsing or softening formulation comprising from 0.05% to 3% of said anionic polysaccharide, expressed as dry matter, capable of directly forming a rinsing and/or softening bath by dilution;

a solid material, comprising from 0.05% to 10% of said anionic polysaccharide, expressed as dry matter, adapted to be placed in contact with wet fabric in a tumble dryer;

an aqueous ironing formulation comprising from 0.05% to 10% of said anionic polysaccharide, expressed as dry matter; or a washing additive comprising from 0.05% to 10% of said anionic polysaccharide, expressed as dry matter, adapted to be placed on the dry fabric prior to a washing operation using a detergent formulation optionally containing said anionic polysaccharide.

20. The process of claim 1, wherein said composition further comprises at least one surfactant or at least one detergent additive or rinsing additive or softening additive for articles made of textile fibers or at least one solid support for said anionic polysaccharide.

21. The process of claim 1, wherein the weight-average molar mass of said composition is up to 2,000,000 g/mole.

22. The process of claim 2, wherein the weight-average molar mass of said composition is up to 2,000,000 g/mole.

23. A process comprising:

applying to a colored textile article a composition consisting essentially of at least one anionic polysaccharide with a weight-average molar mass of greater than 250,000 g/mole, the native skeleton of which is a polysaccharide comprising:

a main chain comprising identical or different anhydrohexose units, and branches comprising at least one neutral or anionic anhydropentose and/or anhydrohexose unit;

wherein the anhydrohexose or anhydropentose units of said anionic polysaccharide are substituted or modified with at least one group, said group comprising an anionic group or a group that is optionally anionized at the working pH of said composition;

the degree of substitution or of modification (DSi) of the anhydrohexose or anhydropentose units with said anionic or anionizable group(s) ranging from 0.1 to less than 3;

wherein said polysaccharide is anionic; and washing and/or drying said colored textile article, wherein the colors of said colored textile article are protected.

24. A process for protecting the colors of colored textile articles or for providing crease-resistance to textile articles, comprising the step of applying to said articles a composition consisting essentially of at least one anionic polysaccharide with a weight-average molar mass of greater than 250,000 g/mole, the native skeleton of which is a polysaccharide comprising:

a main chain comprising identical or different anhydrohexose units, and branches comprising at least one neutral or anionic anhydropentose unit;

wherein the anhydropentose units of said anionic polysaccharide are substituted or modified with at least one group, said group comprising an anionic group or a group that is optionally anionized at the working pH of said composition;

the degree of substitution or of modification (DSi) of the anhydropentose units with said anionic or anionizable group(s) ranging from 0.1 to less than 3;

wherein said polysaccharide is anionic.

* * * * *